US008744324B2

(12) United States Patent
Mizumoto et al.

(10) Patent No.: US 8,744,324 B2
(45) Date of Patent: Jun. 3, 2014

(54) SEMICONDUCTIVE ROLLER, TONER TRANSPORT ROLLER AND ELECTROPHOTOGRAPHIC APPARATUS

(75) Inventors: Yoshihisa Mizumoto, Kobe (JP); Akihiko Kawatani, Kobe (JP); Takashi Marui, Kobe (JP); Kenichi Kuroda, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 216 days.

(21) Appl. No.: 13/175,001

(22) Filed: Jul. 1, 2011

(65) Prior Publication Data

US 2012/0014723 A1 Jan. 19, 2012

(30) Foreign Application Priority Data

Jul. 15, 2010 (JP) ..... 2010-160806
Oct. 4, 2010 (JP) ..... 2010-224982

(51) Int. Cl.
*G03G 15/08* (2006.01)

(52) U.S. Cl.
CPC ..... *G03G 15/0818* (2013.01)
USPC ..... 399/286

(58) Field of Classification Search
CPC ..... G03G 15/0818
USPC ..... 399/176, 286
See application file for complete search history.

(56) References Cited

U.S. PATENT DOCUMENTS

| | | | | |
|---|---|---|---|---|
| 5,278,616 | A | 1/1994 | Hirano et al. | |
| 5,412,456 | A | 5/1995 | Tanuma et al. | |
| 5,475,477 | A | 12/1995 | Tanuma et al. | |
| 2004/0110617 | A1 | 6/2004 | Mizumoto | |
| 2004/0220301 | A1* | 11/2004 | Hattori et al. | 524/155 |
| 2006/0269327 | A1* | 11/2006 | Mizumoto | 399/176 |
| 2006/0284142 | A1* | 12/2006 | Mizumoto | 252/500 |
| 2007/0243984 | A1* | 10/2007 | Mizumoto | 492/49 |
| 2009/0233776 | A1 | 9/2009 | Mizumoto et al. | |
| 2010/0142998 | A1* | 6/2010 | Furukawa et al. | 399/176 |
| 2010/0200814 | A1* | 8/2010 | Marui et al. | 252/500 |
| 2012/0014723 | A1 | 1/2012 | Mizumoto et al. | |

FOREIGN PATENT DOCUMENTS

| | | | |
|---|---|---|---|
| JP | 05-006082 | A | 1/1993 |
| JP | 06-180529 | A | 6/1994 |
| JP | 09-302151 | A | 11/1997 |
| JP | 09309975 | A * | 12/1997 |
| JP | 2001-357735 | A | 12/2001 |
| JP | 2003-43765 | A | 2/2003 |

(Continued)

*Primary Examiner* — David Gray
*Assistant Examiner* — Tyler Hardman
(74) *Attorney, Agent, or Firm* — Birch, Stewart, Kolasch & Birch, LLP

(57) ABSTRACT

The semiconductive roller according to the present invention includes a roller body having an outer peripheral surface made of a crosslinked substance of a semiconductive rubber composition and exhibiting Shore A hardness of not more than 60, the semiconductive rubber composition contains a base polymer made of a mixture of (1) mixed rubber N of liquid nitrile rubber and solid nitrile rubber, (2) chloroprene rubber C, and (3) epichlorohydrin rubber E in a mass ratio (C+E)/N of 10/90 to 80/20, the ratios of the chloroprene rubber and the epichlorohydrin rubber in the total quantity of the base polymer are not less than 5 mass % and not less than 5 mass % respectively, and roller resistance at an applied voltage of 5 V is not less than $10^4\Omega$ and not more than $10^9\Omega$.

5 Claims, 3 Drawing Sheets

(56) References Cited

FOREIGN PATENT DOCUMENTS

| | | | | |
|---|---|---|---|---|
| JP | 2004-170845 | A | | 6/2004 |
| JP | 2005-004010 | A | | 1/2005 |
| JP | 2005-225969 | A | | 8/2005 |
| JP | 2006-099036 | A | | 4/2006 |
| JP | 2006099036 | A | * | 4/2006 |
| JP | 2006-348245 | A | | 12/2006 |
| JP | 2007-286236 | A | | 11/2007 |
| JP | 2008-003458 | A | | 1/2008 |
| JP | 2008-064864 | A | | 3/2008 |
| JP | 2009-222930 | A | | 10/2009 |
| JP | 2010072115 | A | * | 4/2010 |
| JP | 2010-180357 | A | | 8/2010 |
| JP | 2012-022193 | A | | 2/2012 |

* cited by examiner

SEMICONDUCTIVE ROLLER, TONER TRANSPORT ROLLER AND ELECTROPHOTOGRAPHIC APPARATUS

BACKGROUND OF THE INVENTION

1. Field of the Invention

The present invention relates to a semiconductive roller and a toner transport roller employing the same, as well as an electrophotographic apparatus including the toner transport roller.

2. Description of Related Art

Various types of image forming apparatuses utilizing electrophotography are increasingly improved, in order to satisfy requirements for speed increase, improvement in picture quality, colorization and downsizing.

The key to such improvements is toner. In other words, refinement of the toner, uniformization of the particle diameter of the toner, and sphericalization of the toner shape are necessary, in order to satisfy the requirements.

As to the refinement of the toner, fine toner having an average particle diameter of not more than 10 μm or not more than 5 μm has been developed. As to the sphericalization of the toner shape, toner having sphericity exceeding 99% has been developed.

In order to further improve the quality of formed images, polymerized toner is increasingly employed in place of the conventional pulverized toner. The polymerized toner exhibits extremely excellent dot reproducibility particularly in imaging of digital information, to enable formation of high-quality images.

A roller including a roller body made of a crosslinked substance of a semiconductive rubber composition prepared by blending a conductivity supplier such as carbon into a base polymer and a shaft made of a metal or the like inserted into the center of the roller body is generally employed as a developing roller for transporting charged toner to a surface of a photosensitive body and developing an electrostatic latent image formed on the surface into a toner image in an image forming apparatus.

In particular, a semiconductive roller having roller resistance adjusted to not more than $10^8\Omega$ is suitably employed. The semiconductive roller can supply high chargeability to the toner in response to the refinement of the toner, the uniformization of the particle diameter of the toner and the sphericalization of the toner shape or the transition to the polymerized toner, and can efficiently transport the toner to the surface of the photosensitive body without adhering the same to the outer peripheral surface.

While the semiconductive roller must retain the roller resistance over the whole lifetime of the product, the durability of the existing semiconductive rollers is not sufficient for satisfying such a requirement.

In Patent Document 1 (Japanese Unexamined Patent Publication No. 2006-99036), for example, the type of rubber or carbon as the material for a base polymer is adjusted, to supply extremely high chargeability to a roller body of a semiconductive roller in an initial stage of manufacturing. Thus, improvement of initial performance (improvement in quality of an initial image) and retention of the performance (durability) are to be compatibly attained.

According to studies conducted by the inventor, however, only the quality of the initial image or only the durability can be improved at an extremely high level, while it is difficult to compatibly improve both of the quality of the initial image and the durability.

Patent Document 2 (Japanese Unexamined Patent Publication No. 2004-170845) discloses a semiconductive roller including a roller body made of a semiconductive rubber composition obtained by blending a base polymer prepared from ion-conductive rubber having uniform electric characteristics and a filler for adjusting a dielectric loss tangent and having a dielectric loss tangent set to 0.1 to 1.5.

Rubber, represented by epichlorohydrin rubber, containing chlorine atoms in the molecules or rubber containing an ethylene oxide monomer exhibiting ion conductivity as a copolymer component is used as the ion-conductive rubber.

However, the former rubber containing chlorine atoms generally has such high surface free energy that adhesiveness with respect to toner or an external additive such as silica added to the toner in order to improve fluidity or chargeability of the toner tends to increase. Also in the case of the latter rubber, the adhesiveness with respect to the toner or the like tends to increase due to increase in surface free energy.

According to Patent Document 2, further, an oxide film is formed on the outer peripheral surface of the roller body by ultraviolet irradiation or exposure to ozone. In this case, however, the oxygen concentration in the vicinity of the outer peripheral surface increases, and hence the adhesiveness with respect to the toner or the like tends to further increase due to the increase in surface free energy.

In addition, while the quantity of transportation of the toner can be reduced by improving the chargeability of the toner and hence a high-quality image such as a halftone image can be formed when the dielectric loss tangent is adjusted in the above range, the quantity of lamination of the toner is reduced on the outer peripheral surface of the roller body in this case, and hence the adhesiveness with respect to the toner or the like may further increase.

While adhesion of the toner or the like to the roller body does not much influence images formed in an extremely initial stage or continuously formed images, the influence is not negligible if images are formed under any of the following conditions (a) to (d), for example.

For example, while normally charged toner is transported to a reversely charged photosensitive body by electrostatic force (Coulomb force), the transportation of the toner with the electrostatic force is hindered if the adhesiveness of the roller body of the developing roller to the toner or the like is excessively high as described above. Therefore, the image density is reduced if images are formed under any of the following conditions (a) to (d), although the quantity of charge of the toner remains intact. In other words, the developing efficiency of the toner is reduced.

(a) Further images are formed after image formation is properly performed for forming about 2000 images of 1% in density, for example, and the toner relatively fits to the developing roller.

(b) The average particle diameter of the toner is not more than 8 μm, particularly not more than 6 μm.

(c) Images are not continuously formed but an image forming apparatus is temporarily stopped and subsequent images are formed on the next day.

(d) Images are formed in a low temperature and humidity environment, in which the quantity of charge of the toner is relatively increased.

The developing efficiency is particularly easily reduced in an image forming apparatus including a developing roller having a rotational speed set to not less than 20 rpm, for example, due to the speed increase.

When the developing efficiency is reduced, the quantity of toner not consumed by the development but repetitively circulating in a toner box is so increased that the toner is rapidly deteriorated to quicken reduction in the quantity of charge of the toner. Consequently, formed images are easily rendered defective due to the reduction in the quantity of charge.

The deterioration of the toner and the resulting reduction in the quantity of charge are regarded as quickened as the quantity of the transported toner is increased. In order to prevent such deterioration of the toner, the type and the quantity of a filler introduced into the semiconductive rubber composition forming the roller body of the developing roller may be adjusted, to reduce the adhesiveness with respect to the toner or the like and to improve the developing efficiency of the toner.

When the developing efficiency is improved by adjusting the type and the quantity of the filler, however, damage on the toner is rather increased, although the image density is improved. Therefore, the toner is deteriorated before the same is used up, and an image failure such as fogging (a phenomenon causing blackening of white portions of an image), in particular, is frequently caused immediately before the toner is used up.

Patent Document 3 (Japanese Unexamined Patent Publication No. 2005-225969) discloses a technique of preventing adhesion of toner or the like by adding wax to ion-conductive rubber thereby reducing surface free energy on the outer peripheral surface of a roller body. Patent Document 4 (Japanese Unexamined Patent Publication No. 2001-357735) discloses a technique of coating the surface of a conductive member with a treating agent having an amine compound for controlling chargeability of toner.

However, the wax or the amine compound is so easily transferred to the toner or a photosensitive body that the same may contaminate the toner or the photosensitive body, to reduce the quality of formed images. Further, the wax or the amine compound is gradually lost due to the transfer, and hence the effect of the wax or the amine compound cannot be retained over the whole lifetime of the product.

SUMMARY OF THE INVENTION

An object of the present invention is to provide a semiconductive roller capable of preventing an image failure such as fogging before toner is used up when the same is employed as a toner transport roller such as a developing roller and a toner transport roller employing the semiconductive roller, as well as an electrophotographic apparatus employing the toner transport roller.

The semiconductive roller according to the present invention includes a roller body having an outer peripheral surface made of a crosslinked substance of a semiconductive rubber composition and exhibiting Shore A hardness of not more than 60, wherein the semiconductive rubber composition contains a base polymer made of a mixture of:

(1) mixed rubber N of liquid nitrile rubber and solid nitrile rubber;

(2) chloroprene rubber C; and (3) epichlorohydrin rubber E in a mass ratio (C+E)/N of 10/90 to 80/20, the ratios of the chloroprene rubber and the epichlorohydrin rubber in the total quantity of the base polymer are not less than 5 mass % and not less than 5 mass % respectively, and roller resistance at an applied voltage of 5 V is not less than $10^4\Omega$ and not more than $10^9\Omega$.

The crosslinked substance of the mixed rubber N (may hereinafter be referred to as "mixed nitrile rubber") (1) of the liquid nitrile rubber and the solid nitrile rubber employed as the base polymer in the present invention is so flexible that the same cannot obtain sufficient strength as a simple substance, due to the action of the liquid nitrile rubber.

However, the mixed nitrile rubber is excellent in compatibility with the chloroprene rubber (2) having an effect of supplying the roller body with excellent chargeability for toner and the epichlorohydrin rubber (3) which is ion-conductive rubber.

Therefore, uniform ion conductivity can be supplied to the overall roller body of the semiconductive roller due to the action of the epichlorohydrin rubber, by employing the mixed nitrile rubber along with the chloroprene rubber and the epichlorohydrin rubber in the above range of the mass ratio. Further, excellent chargeability and high flexibility can be supplied to the roller body due to the action of the chloroprene rubber and the action of the mixed nitrile rubber respectively.

In other words, the roller resistance of the semiconductive roller at the applied voltage of 5 V can be set to not less than $10^4\Omega$ and not more than $10^9\Omega$. Such roller resistance is the optimum resistance value allowing the semiconductive roller to obtain a sufficient image density and preventing leakage of the charge of the toner.

Further, the Shore A hardness of the roller body at 23±1° C. can be set to not more than 60. Therefore, when the semiconductive roller is employed as a developing roller and brought into contact with the surface of a photosensitive body, for example, a large nip width can be ensured for the roller body. Consequently, the developing efficiency of the toner can be improved. Further, damage on the toner can be reduced due to softness of the roller body.

With the semiconductive roller according to the present invention, therefore, images having a sufficient image density can be formed by improving the quality of an initial image.

The roller body is supplied with the flexibility, due to the employment of extremely flexible mixed rubber (the mixed nitrile rubber), which is the mixture of the solid nitrile rubber and the liquid nitrile rubber crosslinking with the solid nitrile rubber to be incorporated into the crosslinked substance.

If a softener such as oil, for example, is added to supply the roller body with flexibility, the softener may bleed to reduce the flexibility, the toner or the like may adhere to the roller body due to the bleeding softener, or the softener may contaminate the toner or the photosensitive body. When the mixed nitrile rubber is employed, however, there is no possibility of causing such a problem.

Therefore, an effect of improving the developing efficiency of the toner by ensuring slightly reducible but sufficient flexibility and a large nip width resulting therefrom and an effect of reducing damage on the toner can be sufficiently kept basically over the whole lifetime of the product.

Thus, the developing efficiency is originally high due to the large nip width, damage on the toner can be reduced due to the softness and deterioration of the toner can be suppressed by reducing the quantity of toner not consumed by the development but repetitively circulating in the toner box, whereby excellent images can be maintained to the end, and an image failure such as fogging can be prevented before the toner is used up, in particular.

According to the present invention, surface roughness Rz of the outer peripheral surface of the roller body is preferably not less than 2.5 μm and not more than 4.5 μm.

If the surface roughness Rz of the outer peripheral surface exceeds the above range, adhesiveness with respect to the toner or the like is so high that it is not easy to move toner constituting a thin layer formed on the outer peripheral surface to a photosensitive body by electrostatic force and the developing efficiency is reduced as a result. Therefore, the quantity of toner not consumed by the development but remaining on the outer peripheral surface to repetitively pass through a regulating blade or to repetitively circulate in a toner box is increased. Further, the toner is rapidly deteriorated to quicken reduction in the quantity of charge of the toner.

If the surface roughness Rz of the outer peripheral surface is below the above range, on the other hand, the adhesiveness with respect to the toner or the like is so low that the toner easily slips. Therefore, the quantity of toner adherable to the outer peripheral surface is reduced. In other words, the toner cannot be adhered to the outer peripheral surface in a sufficient quantity to be regulated by the regulating blade, and hence no continuous thin layer of the toner can be formed on the outer peripheral surface with a uniform thickness even if the toner is passed through the regulating blade. Consequently, defective images having insufficient or irregular densities are formed.

When the surface roughness Rz of the outer peripheral surface of the roller body having the Shore A hardness of not more than 60 is set in the range of not less than 2.5 μm and not more than 4.5 μm, the adhesiveness with respect to the toner or the like can be properly adjusted.

In other words, the toner can be adhered to the outer peripheral surface of the roller body in a sufficient quantity enabling formation of a thin layer of the toner, passed through the regulating blade, having a uniform thickness. Therefore, the semiconductive roller having the flexible roller body and capable of ensuring a sufficient nip width when brought into contact with the surface of the photosensitive body can prevent formation of defective images having insufficient or irregular densities.

The toner constituting the thin layer formed on the outer peripheral surface by passing through the regulating blade can be moved to the surface of the photosensitive body with high developing efficiency, for developing latent images into toner images. Therefore, excellent images having a sufficient image density can be formed on the surfaces of papers or the like, by transferring the toner images to the surfaces of the papers or the like.

In addition, the quantity of toner not consumed by the development but remaining on the outer peripheral surface to repetitively pass through the regulating blade or to repetitively circulate in the toner box can be reduced to the minimum, thereby suppressing deterioration of the toner and reduction in the quantity of charge resulting therefrom. Consequently, an image failure such as fogging caused before the toner is used up can be prevented.

The roller body is preferably integrally formed by the crosslinked substance, in order to simplify the structure thereof and to improve the developing efficiency by maximizing the nip width. Further, an oxide film is preferably formed on the outer peripheral surface of the roller body by ultraviolet irradiation, in order to reduce the adhesiveness with respect to the toner or the like.

The semiconductive roller according to the present invention can be built into an image forming apparatus such as a laser printer, for example, utilizing electrophotography, to be suitably employed as a toner transport roller such as a developing roller for transporting charged toner to the surface of a photosensitive body and developing a latent image formed on the surface into a toner image.

In other words, the toner transport roller according to the present invention is employed for an image forming apparatus utilizing electrophotography, and formed by the semiconductive roller according to the present invention.

The toner transport roller according to the present invention enables formation of images having a sufficient image density by improving the quality of an initial image, hardly changes the performance, is excellent in durability, and can suppress deterioration of toner and reduction in the quantity of charge resulting therefrom. Therefore, the toner transport roller can prevent an image failure such as fogging caused before the toner is used up.

The electrophotographic apparatus according to the present invention includes the toner transport roller according to the present invention.

Thus, when employed as a toner transport roller such as a developing roller, the semiconductive roller according to the present invention enables formation of images having a sufficient image density by improving the quality of an initial image, hardly changes the performance, is excellent in durability, and can suppress deterioration of toner and reduction in the quantity of charge resulting therefrom. Therefore, the semiconductive roller capable of preventing an image failure such as fogging caused before the toner is used up and the toner transport roller employing the semiconductive roller as well as the electrophotographic apparatus including the toner transport roller can be provided.

The foregoing and other objects, features and effects of the present invention will become more apparent from the following detailed description of the embodiments with reference to the attached drawings.

DETAILED DESCRIPTION OF PREFERRED EMBODIMENTS

Figure 1:
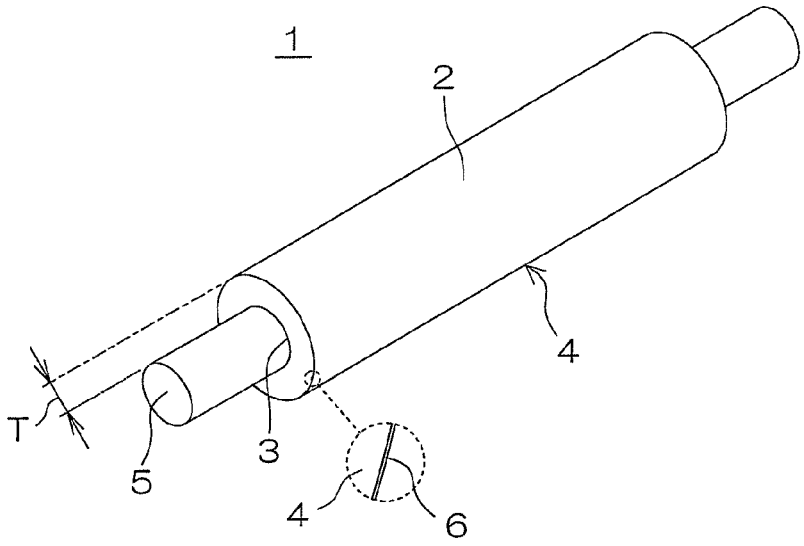
FIG. 1 is a schematic block diagram of a semiconductive roller according to an embodiment of the present invention.

FIG. 1 is a schematic block diagram of a semiconductive roller according to an embodiment of the present invention.

A semiconductive roller 1 includes a cylindrical roller body 4 having an outer peripheral surface 2 made of a semiconductive rubber composition and provided with a through-hole 3 along the axial direction, a shaft 5 inserted into the through-hole 3 at the center of the roller body 4, and an oxide film 6 covering the outer peripheral surface 2 of the roller body 4.

When the semiconductive roller 1 is employed as a charging roller or a developing roller of an electrophotographic apparatus, for example, the thickness (the thickness T between the inner surface of the through-hole 3 and the outer peripheral surface 2) of the roller body 4 is preferably not less than 0.5 mm, more preferably not less than 1 mm, and particularly preferably not less than 3 mm, in order to ensure a proper nip thickness while reducing the charging roller or the developing roller in size and weight. Further, the thickness of the roller body 4 is preferably not more than 15 mm, more preferably not more than 10 mm, and particularly preferably not more than 7 mm.

The semiconductive composition forming the roller body 4 contains a base polymer made of a mixture of:

(1) mixed rubber N of liquid nitrile rubber and solid nitrile rubber;

(2) chloroprene rubber C; and (3) epichlorohydrin rubber E in a mass ratio (C+E)/N of 10/90 to 80/20, the ratios of the chloroprene rubber and the epichlorohydrin rubber in the total quantity of the base polymer are not less than 5 mass % and not less than 5 mass % respectively, and roller resistance at an applied voltage of 5 V is not less than $10^4\Omega$ and not more than $10^9\Omega$).

In the semiconductive rubber composition for forming the semiconductive roller 1, the mixed nitrile rubber (1) can be prepared by mixing liquid nitrile rubber (liquid acrylonitrile-butadiene rubber) liquefied at room temperature (3 to 35° C.) and ordinary solid nitrile rubber (solid acrylonitrile-butadiene rubber) remaining solid at the room temperature in an arbitrary ratio.

The content of the liquid nitrile rubber in the mixed nitrile rubber is preferably not less than 10 mass %, more preferably not less than 30 mass % and particularly preferably not less than 40 mass %, and preferably not more than 90 mass %, and particularly preferably not more than 85 mass %, in order to supply proper strength and high flexibility of the liquid nitrile rubber to the roller body 4 after crosslinking.

If the content of the liquid nitrile rubber is less than the above range, the effect of supplying high flexibility of the liquid nitrile rubber to the roller body 4 after the crosslinking may be so insufficient that Shore A hardness cannot be adjusted to not more than 60.

The liquid nitrile rubber can be prepared from arbitrary nitrile rubber liquefied at room temperature.

The solid nitrile rubber constituting the mixed nitrile rubber along with the liquid nitrile rubber can be prepared from nitrile rubber remaining solid at room temperature and capable of maintaining the shape of the roller body 4. In particular, medium-high nitrile rubber having an acrylonitrile content of 31 to 35% is preferable, in order to supply proper strength to the roller body 4 after the crosslinking and to attain high flexibility by blending the liquid nitrile rubber.

The mixed nitrile rubber can be prepared from Nipol (registered trademark) DN223 [mixed rubber containing liquid medium-high nitrile rubber and solid medium-high nitrile rubber, having the same acrylonitrile contents, in amass ratio of 1:1] by Nippon Zeon Co., Ltd., for example.

However, other mixed nitrile rubber is also employable.

For example, mixed nitrile rubber of liquid nitrile rubber contained in the DN223, and DN401 or DN401LL which is low-nitrile rubber, DN302 which is medium-nitrile rubber, or DN631 which is a carboxyl denaturant of nitrile rubber, each by Nippon Zeon Co., Ltd., can be employed.

Further, mixed nitrile rubber of rubber prepared by liquefying the DN401 and DN401 can also be employed.

The chloroprene rubber (2) can be prepared from any chloroprene rubber. For example, Shoprene (registered trademark) WRT by Showa Denko K. K. or Skypren (registered trademark) by Tosoh Corporation can be employed as the chloroprene rubber.

The quantity of the chloroprene rubber must be not less than 5 mass % of the total quantity of the base polymer, i.e., the total quantity of the rubber materials (1) to (3). If the quantity of the chloroprene rubber is less than the above range, no effect of supplying excellent chargeability for the toner to the roller body 4 after the crosslinking can be attained. Therefore, the developing efficiency is reduced even if high flexibility is supplied to the roller body 4 by employing the mixed nitrile rubber.

The quantity of the chloroprene rubber is preferably not more than 50 mass % in the above arrange. If the quantity of the chloroprene rubber exceeds the above range, the quantities of the remaining two types of rubber may be so relatively reduced that the effects of supplying excellent conductivity and flexibility to the roller body 4 after the crosslinking are insufficient.

The epichlorohydrin rubber (3) can be prepared from any of a homopolymer (CO) of epichlorohydrin, a bicopolymer (ECO) of epichlorohydrin and ethylene oxide and a tricopolymer (GECO) of epichlorohydrin, ethylene oxide and allyl glycidyl ether.

As the CO, Epichromer (registered trademark) H by Daiso Co., Ltd. can be employed, for example.

In order to supply excellent ion conductivity to the roller body 4, the epichlorohydrin rubber is preferably prepared from at least one of ECO and GECO.

As the ECO, Epichromer (registered trademark) D [EO/EP=61/39 (molar ratio)] by Daiso Co., Ltd. can be employed, for example.

As the GECO, at least one of Epion (registered trademark) ON301 [EO/EP/AGE=73/23/4 (molar ratio)] by Daiso Co., Ltd., Epichromer (registered trademark) CG102 [EO/EP/AGE=56/40/4 (molar ratio)] and CG104 [EO/EP/AGE=63/34.5/2.5 (molar ratio)] by Daiso Co., Ltd. and Zeospan (registered trademark) 8030 [EO/EP/AGE=90/4/6 (molar ratio)] by Nippon Zeon Co., Ltd. can be employed, for example.

The quantity of the epichlorohydrin rubber must be not less than 5 mass % of the total quantity of the base polymer, i.e., the total quantity of the rubber materials (1) to (3). If the quantity of the epichlorohydrin rubber is less than the above range, no effect of supplying sufficient ion conductivity to the roller body 4 after the crosslinking is attained.

The quantity of the epichlorohydrin rubber is preferably not more than 50 mass % in the above range. If the quantity of the epichlorohydrin rubber exceeds the above range, the quantities of the remaining two types of rubber may be so relatively reduced that effects of supplying excellent flexibility and excellent chargeability for the toner to the roller body 4 after the crosslinking are insufficient.

The base polymer must be the mixture of the mixed nitrile rubber N (1), the chloroprene rubber C (2) and the epichlorohydrin rubber E (3) in the mass ratio (C+E)/N of 10/90 to 80/20.

If the quantity of the mixed nitrile rubber is smaller than the above range, no effect of improving the developing efficiency by supplying excellent flexibility to the roller body 4 after the crosslinking is attained. If the quantity of the mixed nitrile rubber is larger than the above range, on the other hand, the quantities of the remaining two types of rubber are so relatively reduced that no effects of supplying excellent conductivity and excellent chargeability for the toner to the roller body 4 after the crosslinking can be attained. Therefore, the developing efficiency is rather reduced.

A crosslinking component for crosslinking the base polymer can be introduced into the semiconductive rubber composition. The crosslinking component can be prepared from a material containing both of a peroxide crosslinking agent and a thiourea-based vulcanizing agent, for example. The peroxide crosslinking agent mainly functions as a crosslinking agent for the mixed nitrile rubber and the epichlorohydrin rubber, and the thiourea-based vulcanizing agent mainly functions as a crosslinking agent for the epichlorohydrin rubber and the chloroprene rubber.

The peroxide crosslinking agent can be prepared from one or more of benzoyl peroxide, 1,1-bis(tert-butyl peroxy)-3,3,5-trimethyl cyclohexane, 2,5-dimethyl-2,5-di(benzoyl peroxy)hexane, di(tert-butyl peroxy)diisopropyl benzene, 1,4-bis[(tert-butyl)peroxy isopropyl]benzene, di(tert-butyl peroxy)benzoate, tert-butyl peroxy benzoate, dicumyl peroxide, tert-butyl cumyl peroxide, 2,5-dimethyl-2,5-di(tert-butyl peroxy) hexane, ditert-butyl peroxide and 2,5-dimethyl-2,5-di(tert-butyl peroxy)-3-hexene, for example.

The quantity of the peroxide crosslinking agent is preferably not less than 0.5 parts by mass with respect to 100 parts by mass of the total quantity of the base polymer, and preferably not more than 2 parts by mass.

The thiourea-based vulcanizing agent can be prepared from one or more of tetramethyl thiourea, trimethyl thiourea, ethylene thiourea (2-mercaptoimidazoline) and thiourea expressed as $(C_nH_{2n+1}NH)_2C{=}S$ [where n represents an integer of 1 to 10], for example.

The quantity of the thiourea-based vulcanizing agent is preferably not less than 0.5 parts by mass with respect to 100 parts by mass of the total quantity of the base polymer, and preferably not more than 2 parts by mass.

Any accelerator accelerating vulcanization caused by the thiourea-based vulcanizing agent can also be employed along with the thiourea-based vulcanizing agent.

The accelerator can be prepared from 1,3-di-o-tolyl guanidine (DT), for example.

The quantity of the accelerator can be properly set in response to the type and combination thereof.

The crosslinking component can also be prepared from a material containing both of a sulfur-based vulcanizing agent and a thiourea-based vulcanizing agent. The sulfur-based vulcanizing agent mainly functions as a crosslinking agent for the mixed nitrile rubber, the epichlorohydrin rubber and the chloroprene rubber, and the thiourea-based vulcanizing agent mainly functions as a crosslinking agent for the epichlorohydrin rubber and the chloroprene rubber.

The sulfur-based vulcanizing agent can be prepared from at least one selected from a group consisting of sulfur and a sulfur-containing vulcanizing agent (an organic compound having sulfur in the molecules). The sulfur-containing vulcanizing agent can be prepared from 4,4'-dithiodimorpholine (R), for example. In particular, sulfur is preferable.

The quantity of sulfur is preferably not less than 1 part by mass with respect to 100 parts by mass of the total quantity of the base polymer, and preferably not more than 3 parts by mass.

The thiourea-based vulcanizing agent is as described above. The quantity of the thiourea-based vulcanizing agent is preferably not more than 0.5 parts by mass with respect to 100 parts by mass of the total quantity of the base polymer.

Any accelerator having a function of accelerating vulcanization by the sulfur or the sulfur-containing vulcanizing agent can also be employed along with the sulfur or the sulfur-containing vulcanizing agent.

The accelerator can be prepared from any well-known accelerator. For example, the accelerator can be prepared from at least one of di-2-benzothiazolyl disulfide (DM) and tetramethyl thiuram monosulfide (TS).

Similarly, the aforementioned accelerator such as 1,3-di-o-tolyl guanidine (DT) having the function of accelerating the vulcanization by the thiourea-based vulcanizing agent can also be employed along with the thiourea-based vulcanizing agent.

The quantity of the accelerator can be properly set in response to the type and combination thereof.

A supplement accelerator, a conductive filler, an acid acceptor and the like can be further introduced into the semiconductive rubber composition. In addition, an inorganic filler such as calcium carbonate, alumina or titanium oxide can also be introduced into the semiconductive rubber composition, in order to control the hardness, adhesiveness etc. of the rubber.

The supplement accelerator can be prepared from one or more of a metal oxide such as zinc oxide and aliphatic acid such as stearic acid, oleic acid or cottonseed-oil fatty acid, for example.

The quantity of the supplement accelerator is preferably not less than 3 parts by mass and not more than 7 parts by mass with respect to 100 parts by mass of the total quantity of the base polymer.

The conductive filler can be prepared from at least one of conductive carbon black and titanium oxide, for example.

The quantity of the conductive filler is preferably not less than 10 parts by mass and not more than 40 parts by mass with respect to 100 parts by mass of the total quantity of the base polymer.

The acid acceptor prevents chlorine-based gas generated from the chloroprene rubber and the epichlorohydrin rubber in the vulcanization of the semiconductive rubber composition from remaining and contaminating a photosensitive drum. The acid acceptor is preferably prepared from hydrotalcite, which is excellent in dispersibility into the rubber.

The quantity of the acid acceptor is preferably not less than 1 part by mass and not more than 7 parts by mass with respect to 100 parts by mass of the total quantity of the base polymer.

The semiconductive rubber composition forming the roller body 4 can be prepared similarly to the prior art. For example, the three types of rubber materials (1) to (3) are first blended in a prescribed ratio and masticated. Then, the additives other than the crosslinking component are added to the mixture and kneaded. Then, the semiconductive rubber composition can be prepared by adding the crosslinking agent to the mixture and kneading the same.

The shaft 5 provided on the semiconductive roller 1 is integrally made of a metal such as aluminum, an aluminum alloy or stainless steel, for example. The roller body 4 and the shaft 5 are electrically bonded and mechanically fixed to each other by a conductive adhesive or the like, for example. Thus, the roller body 4 and the shaft 5 can be integrally rotated.

The oxide film 6 is formed by oxidation of the semiconductive rubber composition caused by applying ultraviolet rays to the semiconductive rubber composition forming the roller body 4. The oxide film 6 covers the whole region of the outer peripheral surface 2 of the roller body 4 with a uniform thickness. The oxide film 6, functioning for further reducing adhesiveness of toner or the like, may not be formed as the case may be.

The aforementioned semiconductive roller 1 can be manufactured by the following method, for example.

In order to manufacture the semiconductive roller 1, the semiconductive rubber composition is first prepared as described above, and the prepared semiconductive rubber composition is employed for manufacturing the roller body 4 by a well-known method, for example. More specifically, the semiconductive rubber composition is kneaded, heated and melted by an extruder. Then, the melted composition is passed through a die corresponding to the sectional shape (annular shape) of the roller body 4, to be extruded into a long cylindrical shape. Thus, the roller body 4 having the through-hole 3 is obtained. Then, the obtained roller body 4 is solidified by cooling, and thereafter vulcanized by heating in a vulcanizer, while a temporary shaft for vulcanization is inserted into the through-hole 3.

Then, the shaft 5 having the outer peripheral surface 2 coated with the conductive adhesive is inserted into the through-hole 3 of the roller body 4, in place of the temporary shaft. If the adhesive is a heat-hardening adhesive, the heat-hardening adhesive is hardened by heating, thereby electrically bonding and mechanically fixing the shaft 5 to the roller body 4.

Thereafter the outer peripheral surface 2 of the roller body 4 is polished to have prescribed surface roughness, as necessary. Further, ultraviolet rays are applied to the outer peripheral surface 2 of the roller body 4 as necessary, thereby oxidizing the nitrile rubber N in the crosslinked substance of the semiconductive rubber composition constituting the outer peripheral surface 2. Thus, the oxide film 6 covering the outer peripheral surface 2 is formed. The semiconductive roller 1 shown in FIG. 1 is manufactured through the aforementioned steps.

The roller body 4 may have a two-layer structure of an outer layer on the side of the outer peripheral surface 2 and an inner layer on the side of the shaft 5. In this case, at least the outer layer may be made of the crosslinked substance of the semiconductive rubber composition. In order to simplify the structure of the roller body 4 and to improve the developing efficiency by maximizing a nip width, the roller body 4 is preferably integrally made of the crosslinked substance, as shown in FIG. 1.

In the semiconductive roller 1, the Shore A hardness of the roller body 4 is limited to not more than 60, as described above. This is because the roller body 4 is so insufficient in flexibility if the Shore A hardness thereof exceeds the above range that neither an effect of improving the developing efficiency of the toner by ensuring a large nip width nor an effect of reducing damage on the toner can be attained.

In order to further improve the effects, the Shore A hardness of the roller body 4 is preferably not more than 50 within the above range.

In order to supply proper strength to the roller body 4 thereby supplying proper abrasion resistance against a seal portion or the like sliding on the outer peripheral surface 2 for preventing the toner from leaking out of both ends of the roller body 4, for example, the Shore A hardness of the roller body 4 is preferably not less than 35 within the above range.

In the present invention, the Shore A hardness is expressed by a value measured by the method described in JIS K6253 under the temperature condition of 23±1° C. while putting a weight of 1000 g on a hardness meter and applying a load to a rubber roller.

In the semiconductive roller 1, surface roughness Rz of the outer peripheral surface 2 of the roller body 4 is preferably not less than 2.5 μm and not more than 4.5

If the surface roughness Rz of the outer peripheral surface 2 exceeds the above range, adhesiveness of toner or the like is so high that it is not easy to move toner constituting a thin layer formed on the outer peripheral surface 2 to a photosensitive body by electrostatic force and the developing efficiency is easily reduced as a result. Therefore, the quantity of toner not consumed by the development but remaining on the outer peripheral surface 2 to repetitively pass through a regulating blade or to repetitively circulate in a toner box may be so increased that the toner is rapidly deteriorated to quicken reduction in the quantity of charge of the toner.

If the surface roughness Rz of the outer peripheral surface 2 is smaller than the above range, on the other hand, adhesiveness of the toner or the like is so low that the toner easily slips and hence the quantity of the toner adherable to the outer peripheral surface 2 is easily reduced. In other words, the toner cannot adhere to the outer peripheral surface 2 in a sufficient quantity regulable by the regulating blade, and hence no continuous thin layer of the toner can be formed on the outer peripheral surface 2 with a uniform thickness even if the toner is passed through the regulating blade. Consequently, defective images having insufficient or irregular densities are formed.

In order to adjust the surface roughness Rz of the outer peripheral surface 2 in the above range, the conditions for the polishing performed after the vulcanization of the roller body 4 or the type, the particle diameter and the quantity of the filler added to the semiconductive rubber composition may be adjusted, for example.

In the present invention, the surface roughness Rz is expressed by a value measured according to JIS $B0601_{-1994}$.

The roller resistance of the roller body 4 must be not less than $10^4\Omega$ and not more than $10^9\Omega$, for the following reasons:

If the roller resistance is less than $10^4\Omega$, the semiconductive roller 1 so easily leaks the charge of the toner that the resolution of formed images is reduced due to leakage of the charge in the surface directions of the formed images, for example. If the roller resistance exceeds $10^9\Omega$, on the other hand, no images having a sufficient density can be formed even if the nip width is ensured by setting the Shore A hardness of the roller body 4 to not more than 60.

In order to form more excellent images by suppressing the aforementioned problems, the roller resistance of the semiconductive roller 1 is preferably not less than $10^{6.5}\Omega$ in the above range, and preferably not more than $10^8\Omega$.

The roller resistance of the semiconductive roller 1 is that before the formation of the oxide film 6, in the case of forming the oxide film 6 on the outer peripheral surface 2 of the roller body 4.

Figure 2:
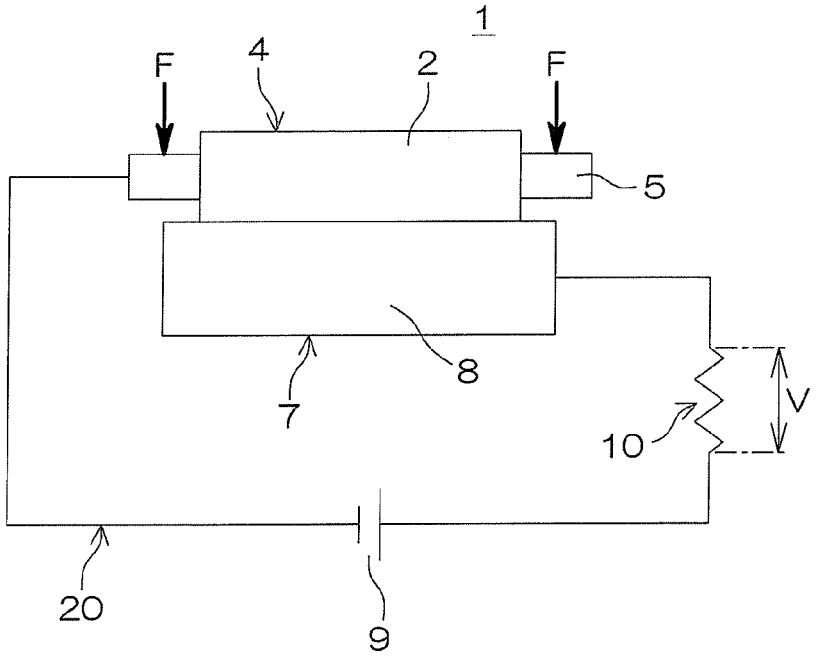
FIG. 2 is a diagram illustrating a method of measuring roller resistance of the semiconductive roller shown in FIG. 1.

The roller resistance of the semiconductive roller 1 can be measured as follows:

FIG. 2 is a diagram illustrating a method of measuring the roller resistance of the semiconductive roller 1 shown in FIG. 1.

In the embodiment, the roller resistance of the semiconductive roller 1 is expressed by a value measured by the following method.

The roller resistance of the semiconductive roller 1 is measured in a room temperature and humidity environment having a temperature of 23±1° C. and relative humidity of 55±1%.

In order to measure the roller resistance, an aluminum drum 7 rotatable at a constant speed is first prepared, for example. Then, the outer peripheral surface 2 of the semiconductive roller 1 whose roller resistance is to be measured is brought into contact with an outer peripheral surface 8 of the aluminum drum 7 from above.

Then, a DC power source 9 and a resistor 10 are serially connected between the shaft 5 of the semiconductive roller 1 and the aluminum drum 7, thereby forming a measuring circuit 20. The minus and plus sides of the DC power source 9 are connected with the shaft 5 and the resistor 10 respectively. The resistance r of the resistor 10 is set to 100Ω.

Then, loads F of 500 g are applied to both end portions of the shaft 5, thereby bringing the roller body 4 into pressure contact with the aluminum drum 7. In this state, a detection voltage V applied to the resistor 10 when applying a DC voltage E of 5 V from the DC power source 9 between the shaft 5 and the aluminum drum 7 while rotating the aluminum drum 7 (at a rotational frequency of 30 rpm) is measured 100 times in four seconds.

From the detection voltage V and the applied voltage E (=5 V), the roller resistance R of the semiconductive roller 1 is basically obtained by the following formula (1'):

$$R=r\times E/(V-r) \quad (1')$$

However, the term −r in the denominator of the formula (1') can be regarded as minute, and hence a value obtained by the following formula (1) is regarded as the roller resistance of the semiconductive roller 1 in the embodiment.

$$R=r\times E/V \quad (1)$$

The roller body 4 can be adjusted to have arbitrary compression set, in response to the application or the like of the semiconductive roller 1. In order to adjust the compression set, the Shore A hardness and the roller resistance, the mass ratio (C+E)/N of the three types of rubber materials (1) to (3) may be adjusted in the aforementioned range or the type and the quantity of the crosslinking component may be adjusted, for example.

The semiconductive roller 1 obtained in the aforementioned manner can be suitably employed as a charging roller of an image forming apparatus such as a laser printer utilizing electrophotography, for example.

Figure 3:
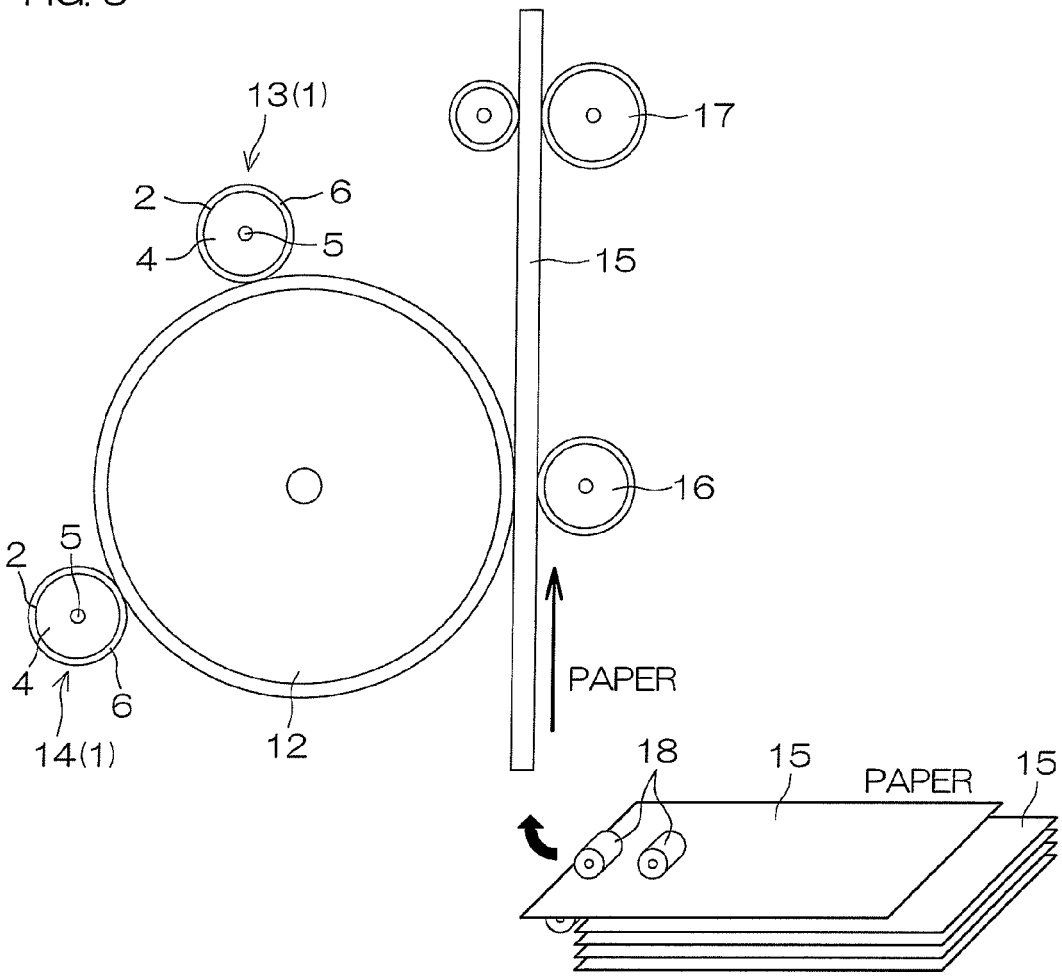
FIG. 3 is a schematic block diagram of an electrophotographic apparatus according to the embodiment of the present invention.

FIG. 3 is a schematic block diagram of an electrophotographic apparatus according to the embodiment of the present invention.

An electrophotographic apparatus 11 includes a photosensitive drum 12, a charging roller 13 in contact with the surface of the photosensitive drum 12 as a toner transport roller for charging the photosensitive drum 12, a developing roller 14 in contact with the surface of the photosensitive drum 12 as another toner transport roller for adhering toner to the surface of the photosensitive drum 12, a transfer roller 16 for transferring the toner to papers 15, a fixing roller 17 for fixing the toner on the papers 15 to the papers 15, and a paper feed roller 18.

The semiconductive roller 1 shown in FIG. 1 is built into the electrophotographic apparatus 11 as each of the charging roller 13 and the developing roller 14.

While the embodiment of the present invention has been described, the present invention may be embodied in other ways.

For example, the electrophotographic apparatus 11 can be formed by an image forming apparatus such as a laser printer, an electrostatic copier, a plain paper facsimile or a composite machine thereof utilizing electrophotography.

The semiconductive roller 1 can be employed as a charging roller, a developing roller, a transfer roller, a cleaning roller or the like of such an image forming apparatus.

EXAMPLES

While the present invention is now described with reference to Examples and comparative examples, the present invention is not restricted to the following Examples and comparative examples.

In each of the following Examples and comparative examples, a semiconductive roller was manufactured and tested in an environment of a temperature of 23±1° C. and relative humidity of 55±1%, unless otherwise stated.

Example 1

A base polymer was prepared by blending:

(1) 80 parts by mass of mixed nitrile rubber [mixed rubber of liquid nitrile rubber and solid nitrile rubber in a mass ratio of 1:1, Nipol (registered trademark) DN223 by Nippon Zeon Co.];

(2) 10 parts by mass of chloroprene rubber [Shoprene (registered trademark) WRT by Showa Denko K. K.]; and (3) 10 parts by mass of epichlorohydrin rubber [GECO, Epion (registered trademark) ON301 by Daiso Co., Ltd., EO/EP/AGE=73/23/4 (molar ratio)].

The mass ratio (C+E)/N of the mixed nitrile rubber N, the chloroprene rubber C and the epichlorohydrin rubber E was 20/80. The ratios of the chloroprene rubber and the epichlorohydrin rubber in the total quantity of the base polymer were 10 mass % and 10 mass % respectively.

A rubber composition was prepared by masticating 100 parts by mass of the total quantity of the base polymer in a Banbury mixer, adding components shown in Table 1 and further kneading the mixture.

TABLE 1

| Component | Part by Mass |
|---|---|
| Peroxide Crosslinking Agent | 1 |
| Thiourea-Based Vulcanizing Agent | 1 |
| Accelerator DT | 0.85 |
| Two Types of Zinc Oxide | 5 |
| Conductive Filler I | 25 |
| Acid Acceptor | 3 |

The components in Table 1 are as follows:

Peroxide crosslinking agent: dicumyl peroxide [Percumyl (registered trademark) D by NOF Corporation]

Thiourea-based vulcanizing agent: ethylene thiourea [2-mercaptoimidazoline, Axel (registered trademark) 22-S by Kawaguchi Chemical Industry Co., Ltd.]

Accelerator DT: 1,3-di-o-tolyl guanidine [guanidine-based accelerator, Nocceler (registered trademark) DT by Ouchi Shinko Chemical Industrial]

Two types of zinc oxide: supplement accelerator [by Mitsui Mining and Smelting Co., Ltd.]

Conductive filler I: conductive carbon black [Denka Black (registered trademark) by Denki Kagaku Kogyo K. K.]

Acid acceptor: hydrotalcite [DHT-4A (registered trademark)-2 by Kyowa Chemical Industry Co., Ltd.]

Table 1 shows the content of each component in parts by mass with respect to 100 parts by mass of the total quantity of the base polymer.

Then, the prepared semiconductive rubber composition was fed to an extruder and extruded into a cylindrical shape having an outer diameter of ϕ22.0 mm and an inner diameter of ϕ9 to 9.5 mm, thereby molding a roller body. Thereafter a temporary shaft for crosslinking having an outer diameter of ϕ8 mm was inserted into a through-hole of the roller body, which in turn was crosslinked in a vulcanizer at 160° C. for one hour.

Then, a shaft of ϕ10 mm in outer diameter having an outer peripheral surface coated with a conductive heat-hardening adhesive was mounted on the roller body in place of the temporary shaft, and heated to 160° C. in an oven to be bonded to the roller body. Thereafter both ends of the roller body were cut, and the outer peripheral surface thereof was traverse-polished with a cylindrical polisher.

Then, the roller body was mirror-polished and so finished that the outer diameter was ϕ20.0 mm (tolerance: 0.05) and surface roughness Rz of the outer peripheral surface was 3 to 7 μm. Thus, the roller body made of a vulcanized substance of the rubber composition and integrated with the shaft was formed.

Then, the outer peripheral surface of the polished roller body was washed with water, and the roller body was set in an ultraviolet irradiator [PL21-200 by Sen Lights Corporation] so that the distance from an UV lamp to the outer peripheral surface was 10 cm. Then, each of ultraviolet rays having wavelengths of 184.9 nm and 253.7 nm was applied to the roller body for five minutes while rotating the roller body on the shaft by 90°. Thus, a semiconductive roller was manufactured by forming an oxide film on the outer peripheral surface.

Example 2

A semiconductive roller was manufactured by preparing a rubber composition similarly to Example 1, except that the quantities of mixed nitrile rubber (1) and chloroprene rubber (2) in a base polymer were set to 60 parts by mass and 30 parts by mass respectively.

The mass ratio (C+E)/N of the mixed nitrile rubber N, the chloroprene rubber C and epichlorohydrin rubber E was 40/60. The ratios of the chloroprene rubber and the epichlorohydrin rubber in the total quantity of the base polymer were 30 mass % and 10 mass % respectively.

Example 3

A semiconductive roller was manufactured by preparing a rubber composition similarly to Example 1, except that the quantities of mixed nitrile rubber (1) and chloroprene rubber (2) in a base polymer were set to 45 parts by mass and 45 parts by mass respectively while the quantity of conductive carbon black was set to 15 parts by mass.

The mass ratio (C+E)/N of the mixed nitrile rubber N, the chloroprene rubber C and epichlorohydrin rubber E was 55/45. The ratios of the chloroprene rubber and the epichlorohydrin rubber in the total quantity of the base polymer were 45 mass % and 10 mass % respectively.

Example 4

A semiconductive roller was manufactured by preparing a rubber composition similarly to Example 1, except that the quantities of mixed nitrile rubber (1) and epichlorohydrin rubber (3) in a base polymer were set to 45 parts by mass and 45 parts by mass respectively while no conductive carbon black was blended.

The mass ratio (C+E)/N of the mixed nitrile rubber N, chloroprene rubber C and the epichlorohydrin rubber E was 55/45. The ratios of the chloroprene rubber and the epichlorohydrin rubber in the total quantity of the base polymer were 10 mass % and 45 mass % respectively.

Example 5

A semiconductive roller was manufactured by preparing a rubber composition similarly to Example 1, except that the quantities of mixed nitrile rubber (1), chloroprene rubber (2) and epichlorohydrin rubber (3) in a base polymer were set to 90 parts by mass, 5 parts by mass and 5 parts by mass respectively.

The mass ratio (C+E)/N of the mixed nitrile rubber N, the chloroprene rubber C and the epichlorohydrin rubber E was 10/90. The ratios of the chloroprene rubber and the epichlorohydrin rubber in the total quantity of the base polymer were 5 mass % and 5 mass % respectively.

Example 6

A semiconductive roller was manufactured by preparing a rubber composition similarly to Example 1, except that 20 parts by mass of the same mixed nitrile rubber (1) as that employed in Example 1, 30 parts by mass of chloroprene rubber (2), and (3)' 50 parts by mass of epichlorohydrin rubber [ECO, Epichromer (registered trademark) D by Daiso Co., Ltd., EO/EP=61/39 (molar ratio)]

were blended as a base polymer while the quantities of a thiourea-based vulcanizing agent, an accelerator DT and conductive carbon black were set to 1.35 parts by mass, 1.26 parts by mass and 10 parts by mass respectively, and 20 parts by mass of titanium oxide [KRONOS KR380 (trade name) by Titan Kogyo K. K.] was added as a conductive filler II.

The mass ratio (C+E)/N of the mixed nitrile rubber N, the chloroprene rubber C and the epichlorohydrin rubber E was 80/20. The ratios of the chloroprene rubber and the epichlorohydrin rubber in the total quantity of the base polymer were 30 mass % and 50 mass % respectively.

Example 7

A rubber composition was prepared by masticating 100 parts 100 parts by mass of a base polymer made of the same three types of rubber materials (1) to (3) as those in Example 1 in a Banbury mixer, adding components shown in Table 2 and further kneading the mixture.

TABLE 2

| Component | Part by Mass |
|---|---|
| Sulfur-Based Vulcanizing Agent | 1.5 |
| Thiourea-Based Vulcanizing Agent | 0.1 |
| Accelerator DM | 0.2 |
| Accelerator TS | 0.5 |
| Accelerator DT | 0.09 |
| Two Types of Zinc Oxide | 5 |
| Conductive Filler I | 20 |
| Acid Acceptor | 3 |

The thiourea-based vulcanizing agent, the accelerator DT, the two types of zinc oxide, the conductive filler I and the acid acceptor in Table 2 are those described above. The remaining components are as follows:

Sulfur-based vulcanizing agent: 200 meshes of powdered sulfur

Accelerator DM: di-2-benzothiazolyl disulfide [Nocceler DM by Ouchi Shinko Chemical Industrial]

Supplement accelerator TS: tetramethyl thiuram monosulfide [Nocceler TS by Ouchi Shinko Chemical Industrial]

A semiconductive roller was manufactured similarly to Example 1, except that the rubber composition was employed.

The mass ratio (C+E)/N of the mixed nitrile rubber N, the chloroprene rubber C and the epichlorohydrin rubber E was 20/80. The ratios of the chloroprene rubber and the epichlorohydrin rubber in the total quantity of the base polymer were 10 mass % and 10 mass % respectively.

Example 8

A semiconductive roller was manufactured by preparing a rubber composition similarly to Example 1, except that the quantities of mixed nitrile rubber (1) and chloroprene rubber (2) in a base polymer were set to 85 parts by mass and 5 parts by mass respectively.

The mass ratio (C+E)/N of the mixed nitrile rubber N, the chloroprene rubber C and epichlorohydrin rubber E was 15/85. The ratios of the chloroprene rubber and the epichlorohydrin rubber in the total quantity of the base polymer were 5 mass % and 10 mass % respectively.

Example 9

A semiconductive roller was manufactured by preparing a rubber composition similarly to Example 1, except that 75 parts by mass of the mixed nitrile rubber (1), 5 parts by mass of chloroprene rubber (2), 10 parts by mass of epichlorohydrin rubber (3) and 10 parts by mass of epichlorohydrin rubber (4) [GECO, Zeospan (registered trademark) 8030 by Nippon Zeon Co., Ltd., EO/EP/AGE=90/4/6 (molar ratio)] were blended as a base polymer while the quantity of conductive carbon black was set to 30 parts by mass and polishing conditions were changed.

The mass ratio (C+E)/N of the mixed nitrile rubber N, the chloroprene rubber C and the epichlorohydrin rubber E was 25/75. The ratios of the chloroprene rubber and the epichlorohydrin rubber in the total quantity of the base polymer were 5 mass % and 20 mass % respectively.

Example 10

A semiconductive roller was manufactured by preparing a rubber composition similarly to Example 1, except that 70 parts by mass of the mixed nitrile rubber (1), 10 parts by mass of chloroprene rubber (2), 10 parts by mass of epichlorohydrin rubber (3) and 10 parts by mass of epichlorohydrin rubber (4) were blended as a base polymer while the quantity of conductive carbon black was set to 25 parts by mass and polishing conditions were changed.

The mass ratio (C+E)/N of the mixed nitrile rubber N, the chloroprene rubber C and the epichlorohydrin rubber E was 30/70. The ratios of the chloroprene rubber and the epichlorohydrin rubber in the total quantity of the base polymer were 10 mass % and 20 mass % respectively.

Example 11

A semiconductive roller was manufactured by preparing a rubber composition similarly to Example 1, except that 80 parts by mass of the mixed nitrile rubber (1), 10 parts by mass of chloroprene rubber (2) and 10 parts by mass of epichlorohydrin rubber (3) were blended as a base polymer while the quantity of conductive carbon black was set to 35 parts by mass and polishing conditions were changed.

The mass ratio (C+E)/N of the mixed nitrile rubber N, the chloroprene rubber C and the epichlorohydrin rubber E was 20/80. The ratios of the chloroprene rubber and the epichlorohydrin rubber in the total quantity of the base polymer were 10 mass % and 10 mass % respectively.

Example 12

A semiconductive roller was manufactured by preparing a rubber composition similarly to Example 1, except that 80 parts by mass of the mixed nitrile rubber (1), 5 parts by mass of chloroprene rubber (2) and 15 parts by mass of epichlorohydrin rubber (3) were blended as a base polymer while the quantity of conductive carbon black was set to 45 parts by mass and polishing conditions were changed.

The mass ratio (C+E)/N of the mixed nitrile rubber N, the chloroprene rubber C and the epichlorohydrin rubber E was 20/80. The ratios of the chloroprene rubber and the epichlorohydrin rubber in the total quantity of the base polymer were 5 mass % and 15 mass % respectively.

Example 13

A semiconductive roller was manufactured by preparing a rubber composition similarly to Example 1, except that 80 parts by mass of the mixed nitrile rubber (1), 5 parts by mass of chloroprene rubber (2), 10 parts by mass of epichlorohydrin rubber (3) and 5 parts by mass of epichlorohydrin rubber (4) were blended as a base polymer while the quantity of conductive carbon black was set to 35 parts by mass and polishing conditions were changed.

The mass ratio (C+E)/N of the mixed nitrile rubber N, the chloroprene rubber C and the epichlorohydrin rubber E was 20/80. The ratios of the chloroprene rubber and the epichlorohydrin rubber in the total quantity of the base polymer were 5 mass % and 20 mass % respectively.

Example 14

A semiconductive roller was manufactured by preparing a rubber composition similarly to Example 1, except that 80 parts by mass of the mixed nitrile rubber (1), 10 parts by mass of chloroprene rubber (2) and 10 parts by mass of epichlorohydrin rubber (3) were blended as a base polymer while the quantity of conductive carbon black was set to 30 parts by mass and polishing conditions were changed.

The mass ratio (C+E)/N of the mixed nitrile rubber N, the chloroprene rubber C and the epichlorohydrin rubber E was 20/80. The ratios of the chloroprene rubber and the epichlorohydrin rubber in the total quantity of the base polymer were 10 mass % and 10 mass % respectively.

Example 15

A semiconductive roller was manufactured by preparing a rubber composition similarly to Example 1, except that 70 parts by mass of mixed nitrile rubber (1), 10 parts by mass of chloroprene rubber (2), 10 parts by mass of epichlorohydrin rubber (3) and 10 parts by mass of epichlorohydrin rubber (4) were blended as a base polymer while the quantity of conductive carbon black was set to 40 parts by mass and polishing conditions were changed.

The mass ratio (C+E)/N of the mixed nitrile rubber N, the chloroprene rubber C and the epichlorohydrin rubber E was 30/70. The ratios of the chloroprene rubber and the epichlorohydrin rubber in the total quantity of the base polymer were 10 mass % and 20 mass % respectively.

Comparative Example 1

A semiconductive roller was manufactured by preparing a rubber composition similarly to Example 1, except that the quantities of mixed nitrile rubber (1), chloroprene rubber (2) and epichlorohydrin rubber (3) in a base polymer were set to 18 parts by mass, 70 parts by mass and 12 parts by mass respectively while the quantities of conductive carbon black and an acid acceptor were set to 11 parts by mass and 6 parts by mass respectively.

The mass ratio (C+E)/N of the mixed nitrile rubber N, the chloroprene rubber C and the epichlorohydrin rubber E was 82/18. The ratios of the chloroprene rubber and the epichlorohydrin rubber in the total quantity of the base polymer were 70 mass % and 12 mass % respectively.

Comparative Example 2

A semiconductive roller was manufactured by preparing a rubber composition similarly to Example 7, except that the quantities of mixed nitrile rubber (1), chloroprene rubber (2) and epichlorohydrin rubber (3) in a base polymer were set to 92 parts by mass, 3 parts by mass and 5 parts by mass respectively.

The mass ratio (C+E)/N of the mixed nitrile rubber N, the chloroprene rubber C and the epichlorohydrin rubber E was 8/92. The ratios of the chloroprene rubber and the epichlorohydrin rubber in the total quantity of the base polymer were 3 mass % and 5 mass % respectively.

Comparative Example 3

A semiconductive roller was manufactured by preparing a rubber composition similarly to Example 7, except that 20 parts by mass of the same chloroprene rubber (2) as that employed in Example 1, 70 parts by mass of epichlorohydrin rubber (3), and (3)" 10 parts by mass of epichlorohydrin rubber [GECO, Zeospan (registered trademark) 8030 by Nippon Zeon Co., Ltd., EO/EP/AGE=90/4/6 (molar ratio)]

were blended as a base polymer, the quantities of carbon black and an acid acceptor were set to 10 parts by mass and 6 parts by mass respectively and 20 parts by mass of titanium oxide [KRONOS KR380 (trade name) by Titan Kogyo K. K.] was added.

Comparative Example 4

A semiconductive roller was manufactured by preparing a rubber composition similarly to Example 7, except that 30 parts by mass of the same chloroprene rubber (2) as that employed in Example 1, 50 parts by mass of the same epichlorohydrin rubber (3)' as that employed in Example 6 and 20 parts by mass of solid nitrile rubber [Nipol 401LL by Nippon Zeon Co., Ltd.] containing no liquid nitrile rubber were blended as a base polymer, the quantity of carbon black was set to 10 parts by mass and 20 parts by mass of titanium oxide [KRONOS KR380 (trade name) by Titan Kogyo K. K.] was added.

Comparative Example 5

A semiconductive roller was manufactured by preparing a rubber composition similarly to Example 1, except that 20 parts by mass of chloroprene rubber (2), 70 parts by mass of epichlorohydrin rubber (3) and 10 parts by mass of epichlorohydrin rubber (4) were blended as a base polymer, the quantity of conductive carbon black was set to 36 parts by mass and polishing conditions were changed.

The mass ratio (C+E)/N of the mixed nitrile rubber N, the chloroprene rubber C and the epichlorohydrin rubber E was 100/0. The ratios of the chloroprene rubber and the epichlorohydrin rubber in the total quantity of the base polymer were 20 mass % and 80 mass % respectively.

Comparative Example 6

A semiconductive roller was manufactured by preparing a rubber composition similarly to Example 1, except that 70 parts by mass of mixed nitrile rubber (1), 10 parts by mass of chloroprene rubber (2), 10 parts by mass of epichlorohydrin rubber (3) and 10 parts by mass of epichlorohydrin rubber (4) were blended as a base polymer, the quantity of conductive carbon black was set to 63 parts by mass and polishing conditions were changed.

The mass ratio (C+E)/N of the mixed nitrile rubber N, the chloroprene rubber C and the epichlorohydrin rubber E was 30/70. The ratios of the chloroprene rubber and the epichlorohydrin rubber in the total quantity of the base polymer were 10 mass % and 10 mass % respectively.

<Evaluation>

(1) Measurement of Shore A Hardness

The Shore A hardness of the roller body of the semiconductive roller manufactured according to Examples and comparative examples was measured under conditions of a temperature of 23±1° and loads of 100 gf on both ends according to JIS K6253.

(2) Measurement of Roller Resistance

The roller resistance of the semiconductive roller, not yet provided with an oxide film on the outer peripheral surface of the roller body, according to each of Examples and comparative examples was measured by the aforementioned method. Tables 3 to 6 show the values of the roller resistance in logR.

(3) Measurement of Surface Roughness

The surface roughness Rz of the roller body was measured according to JIS $B0601_{-1994}$.

(4) Evaluation of Initial Characteristics

The semiconductive roller manufactured according to each of Examples and comparative examples was built into a toner cartridge of a commercially available laser printer [employing positively charged nonmagnetic one-component toner, corresponding to 7000 toner-recommended prints] as a developing roller. Then, 100 images of 5% in density were continuously formed with the laser printer in a room temperature and humidity environment having a temperature of 23±1° C. and relative humidity of 55±1%, and a halftone image of 25% in density was thereafter formed as the $101^{st}$ image.

Then, the toner cartridge was detached from the laser printer, and the toner was sucked from the developing roller with a suction type q/m meter [Q/M METER Model 210HS-2 by Trek Japan Co., Ltd.] from above, to measure the quantity (μC) of charge and the mass (mg) of the toner. The quantity (μC/g) of charge of the toner per unit mass was obtained from the quantity (μC) of charge and the mass (mg) of the toner, as the initial quantity of charge. Further, the quantity ($mg/cm^2$) of transportation of the toner per unit area was obtained from the mass (mg) of the toner and the sucked area ($cm^2$), as the initial quantity of transportation.

(5) Evaluation of Developing Efficiency

After forming images with the same laser printer as the above, the developing efficiency was evaluated with reference to change in the quantity of the toner, i.e., the quantity of lamination of the toner in the formed images. The quantity of lamination of the toner was obtained by measuring the following transmission density.

100 images of 5% in density were continuously formed with the laser printer in a room temperature and humidity environment having a temperature of 23±1° C. and relative humidity of 55±1%, and a black solid image was formed as the $101^{st}$ image. Transmission densities on arbitrary five points of the black solid image were measured with a reflective transmission densitometer ["Techkon densitometer RT/120/Light Table LP20" by Techkon Co., Ltd.] and averaged, to evaluate the developing efficiency of each semiconductive roller as follows:

Transmission density of not more than 1.6: Extremely thin. Quantity of lamination of toner extremely small. Developing efficiency extremely low (x).

Transmission density in excess of 1.6 and not more than 1.8: Thin. Quantity of lamination of toner small. Developing efficiency low (Δ).

Transmission density in excess of 1.8 and not more than 2.0: Slightly thin. Quantity of lamination of toner slightly small. Developing efficiency slightly low but nonproblematic in practice (○).

Transmission density in excess of 2.0 and not more than 2.4: Proper. Quantity of lamination of toner excellent. Developing efficiency excellent (◎).

Transmission density in excess of 2.4: Dense. Quantity of lamination of toner large. Developing efficiency excessively high (x).

(6) Evaluation of Durability

Intermittent paper feeding (completely forming an image and then forming another image after a temporary stop time) for forming one image of 5% in density in 15 seconds was executed 1500 times a day with the same laser printer as the above in a high temperature and humidity environment having a temperature of 30±1° C. and relative humidity of 80±1%. The presence or absence of fogging on the image was visually observed when the toner was used up and the laser printer was stopped, to evaluate the durability as follows:

The image was not fogged, or slightly fogged at a visually unobservable level: stage 1.

The image was slightly fogged on an end portion: stage 2.

The image was clearly fogged on an end portion: stage 3.

The image was slightly fogged over: stage 4.

The image was clearly fogged over: stage 5.

The stages 1, 2 and 3 to 5 were evaluated as extremely excellent (◎), excellent (○) and defective (x) respectively.

Tables 3 to 6 show the results.

TABLE 3

| | | | Example 5 | Example 1 | Example 2 | Example 3 | Example 4 | Example 6 |
|---|---|---|---|---|---|---|---|---|
| Part by Mass | Mixed Nitrile Rubber | DN223 | 90 | 80 | 60 | 45 | 45 | 20 |
| | Solid Nitrile Rubber | 401LL | — | — | — | — | — | — |
| | Chloroprene Rubber | WRT | 5 | 10 | 30 | 45 | 10 | 30 |
| | GECO | ON301 | 5 | 10 | 10 | 10 | 45 | — |
| | ECO | D | — | — | — | — | — | 50 |
| | GECO | 8030 | — | — | — | — | — | — |
| | (C + E)/N | | 10/90 | 20/80 | 40/60 | 55/45 | 55/45 | 80/20 |
| | Peroxide Crosslinking Agent | | 1 | 1 | 1 | 1 | 1 | 1 |
| | Sulfur-Based Vulcanizing Agent | | — | — | — | — | — | — |
| | Accelerator DM | | — | — | — | — | — | — |
| | Accelerator TS | | — | — | — | — | — | — |
| | Thiourea-Based Vulcanizing Agent | | 1 | 1 | 1 | 1 | 1 | 1.35 |
| | Accelerator DT | | 0.85 | 0.85 | 0.85 | 0.85 | 0.85 | 1.26 |
| | Two Types of Zinc Oxide | | 5 | 5 | 5 | 5 | 5 | 5 |
| | Conductive Filler I | | 25 | 25 | 25 | 15 | — | 10 |
| | Conductive Filler II | | — | — | — | — | — | 20 |
| | Acid Acceptor | | 3 | 3 | 3 | 3 | 3 | 3 |
| Evaluation | Shore A Hardness | | 42 | 50 | 59 | 55 | 39 | 59 |
| | Roller Resistance (logR) | | 6.8 | 6.6 | 6.3 | 8.5 | 7.9 | 7.1 |
| | Surface Roughness Rz(μm) | | 4.5 | 4.3 | 5.0 | 5.0 | 7.0 | 5.7 |
| | Initial Quantity of Charge (μC/g) | | 35 | 36 | 35 | 36 | 32 | 29 |
| | Initial Quantity of Transportation(mg/cm$^2$) | | 0.29 | 0.29 | 0.29 | 0.41 | 0.38 | 0.31 |
| | Toner Adhesiveness | Transmission Density | 2.07 | 2.07 | 2.07 | 1.74 | 2.10 | 2.01 |
| | | Evaluation | ◎ | ◎ | ◎ | ○ | ◎ | ◎ |
| | Durability | Stage | 2 | 1 | 2 | 1 | 1 | 2 |
| | | Evaluation | ○ | ◎ | ○ | ◎ | ◎ | ○ |

TABLE 4

| | | | Example 7 | Comp. Example 1 | Comp. Example 2 | Comp. Example 3 | Comp. Example 4 |
|---|---|---|---|---|---|---|---|
| Part by Mass | Mixed Nitrile Rubber | DN223 | 80 | 18 | 92 | — | — |
| | Solid Nitrile Rubber | 401LL | — | — | — | — | 20 |
| | Chloroprene Rubber | WRT | 10 | 70 | 3 | 20 | 30 |
| | GECO | ON301 | 10 | 12 | 5 | 70 | — |
| | ECO | D | — | — | — | — | 50 |
| | GECO | 8030 | — | — | — | 10 | — |
| | (C + E)/N | | 20/80 | 82/18 | 8/92 | — | — |
| | Peroxide Crosslinking Agent | | — | 1 | — | — | — |
| | Sulfur-Based Vulcanizing Agent | | 1.5 | — | 1.5 | 1.5 | 1.5 |
| | Accelerator DM | | 0.2 | — | 0.2 | 0.2 | 0.2 |
| | Accelerator TS | | 0.5 | — | 0.5 | 0.5 | 0.5 |
| | Thiourea-Based Vulcanizing Agent | | 0.1 | 1 | 0.1 | 0.1 | 0.1 |
| | Accelerator DT | | 0.09 | 0.85 | 0.09 | 0.09 | 0.09 |
| | Two Types of Zinc Oxide | | 5 | 5 | 5 | 5 | 5 |
| | Conductive Filler I | | 20 | 11 | 20 | 10 | 10 |
| | Conductive Filler II | | — | — | — | 20 | 20 |
| | Acid Acceptor | | 3 | 6 | 3 | 6 | 3 |
| Evaluation | Shore A Hardness | | 48 | 60 | 45 | 68 | 63 |
| | Roller Resistance (logR) | | 8.0 | 8.1 | 9.2 | 6.2 | 6.9 |
| | Surface Roughness Rz(μm) | | 6.0 | 3.9 | 7.0 | 3.9 | 5.7 |

TABLE 4-continued

| | | | Example 7 | Comp. Example 1 | Comp. Example 2 | Comp. Example 3 | Comp. Example 4 |
|---|---|---|---|---|---|---|---|
| | Initial Quantity of Charge (μC/g) | | 34 | 33 | 29 | 34 | 29 |
| | Initial Quantity of Transportation ($mg/cm^2$) | | 0.32 | 0.44 | 0.49 | 0.43 | 0.49 |
| | Toner Adhesiveness | Transmission Density | 2.03 | 1.54 | 1.50 | 2.02 | 2.15 |
| | | Evaluation | ◎ | X | X | ◎ | ◎ |
| | Durability | Stage | 1 | 2 | 2 | 3 | 3 |
| | | Evaluation | ◎ | ○ | ○ | X | X |

TABLE 5

| | | | Comp. Example 5 | Example 8 | Example 9 | Example 10 | Example 11 |
|---|---|---|---|---|---|---|---|
| Part by Mass | Mixed Nitrile Rubber | DN223 | — | 85 | 75 | 70 | 80 |
| | Chloroprene Rubber | WRT | 20 | 5 | 5 | 10 | 10 |
| | GECO | ON301 | 70 | 10 | 10 | 10 | 10 |
| | | 8030 | 10 | — | 10 | 10 | — |
| | (C + E)/N | | 100/0 | 15/85 | 25/75 | 30/70 | 20/80 |
| | Peroxide Crosslinking Agent | | 1 | 1 | 1 | 1 | 1 |
| | Thiourea-Based Vulcanizing Agent | | 1 | 1 | 1 | 1 | 1 |
| | Accelerator DT | | 0.85 | 0.85 | 0.85 | 0.85 | 0.85 |
| | Two Types of Zinc Oxide | | 5 | 5 | 5 | 5 | 5 |
| | Conductive Filler | | 36 | 20 | 30 | 25 | 35 |
| | Acid Acceptor | | 3 | 3 | 3 | 3 | 3 |
| Evaluation | Shore A Hardness | | 68 | 47 | 50 | 51.5 | 52.5 |
| | Surface Roughness Rz (μm) | | 3.9 | 4.2 | 3.5 | 4.1 | 4.5 |
| | Roller Resistance (logR) | | 6.2 | 8.0 | 7.8 | 7.3 | 7.8 |
| | Durability | Stage | 3 | 1 | 1 | 2 | 1 |
| | | Evaluation | X | ◎ | ◎ | ○ | ◎ |

TABLE 6

| | | | Example 12 | Example 13 | Example 14 | Example 15 | Comp. Example 6 |
|---|---|---|---|---|---|---|---|
| Part by Mass | Mixed Nitrile Rubber | DN223 | 80 | 80 | 80 | 70 | 70 |
| | Chloroprene Rubber | WRT | 5 | 5 | 10 | 10 | 10 |
| | GECO | ON301 | 15 | 10 | 10 | 10 | 10 |
| | | 8030 | — | 5 | — | 10 | 10 |
| | (C + E)/N | | 20/80 | 20/80 | 20/80 | 30/70 | 30/70 |
| | Peroxide Crosslinking Agent | | 1 | 1 | 1 | 1 | 1 |
| | Thiourea-Based Vulcanizing Agent | | 1 | 1 | 1 | 1 | 1 |
| | Accelerator DT | | 0.85 | 0.85 | 0.85 | 0.85 | 0.85 |
| | Two Types of Zinc Oxide | | 5 | 5 | 5 | 5 | 5 |
| | Conductive Filler | | 45 | 35 | 30 | 40 | 63 |
| | Acid Acceptor | | 3 | 3 | 3 | 3 | 3 |
| Evaluation | Shore A Hardness | | 55 | 56 | 57 | 58 | 65 |
| | Surface Roughness Rz (μm) | | 3.3 | 3.1 | 3.3 | 4.3 | 2.4 |
| | Roller Resistance (logR) | | 6.4 | 6.0 | 6.4 | 5.7 | 6.0 |
| | Durability | Stage | 2 | 1 | 1 | 1 | 3 |
| | | Evaluation | ○ | ◎ | ◎ | ◎ | X |

From the results of comparative examples 1 to 4 and Examples 1 to 7 shown in Tables 3 and 4, it has been confirmed that the quality of the initial image can be improved by improving the developing efficiency and an image failure such as fogging can be prevented before toner is used up when the semiconductive roller is used as a developing roller, by combining the three types of rubber materials (1) to (3) as the base polymer and setting the mass ratio (C+E)/N thereof in the range of 10/90 to 80/20 while setting the Shore A hardness of the roller body to not more than 60 and setting the roller resistance of the semiconductive roller to not less than $10^4\Omega$ and not more than $10^9\Omega$.

From the results shown in Tables 5 and 6, it has been confirmed that an image failure such as fogging can be prevented before toner is used up when the semiconductive roller is employed as a developing roller, by setting the Shore A hardness of the roller body to not more than 60 and setting the surface roughness Rz of the outer peripheral surface to not less than 2.5 μm and not more than 4.5 μm.

While the present invention has been described in detail by way of the embodiment thereof, it should be understood that the embodiment is merely illustrative of the technical principles of the present invention but not limitative of the invention. The spirit and scope of the present invention are to be limited only by the appended claims.

This application corresponds to Japanese Patent Application No. 2010-160806 filed with the Japan Patent Office on Jul. 15, 2010 and Japanese Patent Application No. 2010-224982 filed with the Japan Patent Office on Oct. 4, 2010, the disclosures of which are incorporated herein by reference.

What is claimed is:

1. A semiconductive roller comprising:

a roller body having an outer peripheral surface made of a crosslinked substance of a semiconductive rubber composition and exhibiting Shore A hardness of not more than 60, wherein the semiconductive rubber composition contains a base polymer made of a mixture of:

(1) mixed rubber N of liquid nitrile rubber and solid nitrile rubber;

(2) chloroprene rubber C; and (3) epichlorohydrin rubber E in a mass ratio (C+E)/N of greater than or equal to 10/90 and less than 80/20, the ratios of the chloroprene rubber and the epichlorohydrin rubber in the total quantity of the base polymer are not less than 5 mass % and not less than 5 mass % respectively, and roller resistance at an applied voltage of 5 V is not less than $10^4\Omega$ and not more than $10^9\Omega$.

2. The semiconductive roller according to claim 1, wherein surface roughness Rz of the outer peripheral surface of the roller body is not less than 2.5 μm and not more than 4.5 μm.

3. The semiconductive roller according to claim 1, wherein the roller body is integrally formed by the crosslinked substance, and the semiconductive roller further comprises an oxide film, formed by ultraviolet irradiation, covering the outer peripheral surface of the roller body.

4. A toner transport roller, employed for an image forming apparatus utilizing electrophotography, comprising:

a roller body having an outer peripheral surface made of a crosslinked substance of a semiconductive rubber composition and exhibiting Shore A hardness of not more than 60, wherein the semiconductive rubber composition contains a base polymer made of a mixture of:

(1) mixed rubber N of liquid nitrile rubber and solid nitrile rubber;

(2) chloroprene rubber C; and (3) epichlorohydrin rubber E in a mass ratio (C+E)/N of greater than or equal to 10/90 and less than 80/20, the ratios of the chloroprene rubber and the epichlorohydrin rubber in the total quantity of the base polymer are not less than 5 mass % and not less than 5 mass % respectively, and roller resistance at an applied voltage of 5 V is not less than $10^4\Omega$ and not more than $10^9\Omega$.

5. An electrophotographic apparatus comprising:

a toner transport roller, wherein the toner transport roller includes:

a roller body having an outer peripheral surface made of a crosslinked substance of a semiconductive rubber composition and exhibiting Shore A hardness of not more than 60, the semiconductive rubber composition contains a base polymer made of a mixture of:

(1) mixed rubber N of liquid nitrile rubber and solid nitrile rubber;

(2) chloroprene rubber C; and (3) epichlorohydrin rubber E in a mass ratio (C+E)/N of greater than or equal to 10/90 and less than 80/20, the ratios of the chloroprene rubber and the epichlorohydrin rubber in the total quantity of the base polymer are not less than 5 mass % and not less than 5 mass % respectively, and roller resistance at an applied voltage of 5 V is not less than $10^4\Omega$ and not more than $10^9\Omega$.

* * * * *